US007441608B2

(12) United States Patent
Keskiniva et al.

(10) Patent No.: US 7,441,608 B2
(45) **Date of Patent: *Oct. 28, 2008**

(54) PERCUSSION DEVICE WITH A TRANSMISSION ELEMENT COMPRESSING AN ELASTIC ENERGY STORING MATERIAL

(75) Inventors: Markku Keskiniva, Tampere (FI); Erkki Ahola, Kangasala (FI); Ari Kotala, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

This patent is subject to a terminal disclaimer.

(21) Appl. No.: 11/819,304

(22) Filed: Jun. 26, 2007

(65) Prior Publication Data

US 2007/0246236 A1 Oct. 25, 2007

Related U.S. Application Data

(62) Division of application No. 10/982,893, filed on Nov. 8, 2004, now Pat. No. 7,252,154.

(30) Foreign Application Priority Data

May 8, 2002 (FI) ..... 20020881
May 7, 2003 (WO) ..... PCT/FI03/00354

(51) Int. Cl.
*B25D 9/00* (2006.01)

(52) U.S. Cl. ..... 173/91; 173/200; 173/204; 173/202

(58) Field of Classification Search ..... 173/91, 173/200, 14, 204, 202, 212, 206
See application file for complete search history.

(56) References Cited

U.S. PATENT DOCUMENTS 3,431,985 A 3/1969 Bowen et al.

FOREIGN PATENT DOCUMENTS

GB 2 079 214 1/1982

(Continued)

OTHER PUBLICATIONS

International Search Report mailed Jul. 10, 2003 in International PCT Application No. PCT/FI03/00354.

(Continued)

*Primary Examiner*—Brian D Nash
(74) *Attorney, Agent, or Firm*—Drinker Biddle & Reath LLP

(57) ABSTRACT

A percussion device for a rock drilling machine or the like, which includes providing an impact, i.e. a stress pulse, to a tool connected to the percussion device. The the stress pulse is provided by way of a stress element of liquid, which is supported to a body of the percussion device. The stress element is subjected to pressure and correspondingly the stress element is released abruptly, whereby the stress energy is discharged as a stress pulse to the tool in direct or indirect contact with the stress element.

9 Claims, 4 Drawing Sheets

U.S. PATENT DOCUMENTS

| | | | |
|---|---|---|---|
| 4,159,039 | A | 6/1979 | Kasuga et al. |
| 4,690,225 | A | 9/1987 | Tupitsyn et al. |
| 6,854,538 | B2 | 2/2005 | Muuttonen |
| 7,013,996 | B2 | 3/2006 | Keshiniva et al. |

FOREIGN PATENT DOCUMENTS

| | | |
|---|---|---|
| JP | 1-103272 | 4/1989 |
| SU | 648726 | 2/1977 |
| SU | 554404 | 4/1977 |
| SU | 619638 | 8/1978 |
| WO | 96/19323 | 6/1996 |

OTHER PUBLICATIONS

Finnish Official Action mailed Feb. 2, 2003 in Finnish Application No. 20020881.

Database WPI, Week 197924, Derwent Publications, Ltd., London, AN 1979-F2664B, Abstract of SU 619638 (attached to patent publication).

Database WPI, Week 197947, Derwent Publications, Ltd., London, AN 1979-K9217B, Abstract of SU 648726 (attached to patent publication).

PERCUSSION DEVICE WITH A TRANSMISSION ELEMENT COMPRESSING AN ELASTIC ENERGY STORING MATERIAL

This is a Divisional of application Ser. No. 10/982,893, filed Nov. 8, 2004 now U.S. Pat. No. 7,252,154, which is a PCT National Stage of PCT/FI03/00354 filed May 7, 2003, which claim priority to Finland Application No. 20020881 filed May 8, 2002.

FIELD OF THE INVENTION

The invention relates to a percussion device having means for providing a stress pulse in a tool connected to the percussion device.

BACKGROUND OF THE INVENTION

In known percussion devices an impact is produced using a reciprocating percussion piston, whose motion is typically generated hydraulically or pneumatically and in some cases electrically or by means of a combustion engine. A stress pulse is produced in the tool, such as a drill rod, when the percussion piston strikes the impact surface of a shank adapter or tool.

The known percussion devices have a drawback that the reciprocating motion of the percussion piston generates dynamic acceleration forces that make the control of the apparatus difficult. As the percussion piston accelerates in the striking direction, at the same time the body of the percussion device tends to move in the opposite direction so as to alleviate the pressing force of a drill bit or a tool tip with respect to the material to be treated. In order to maintain the pressing force of the drill bit or the tool sufficient against the material to be treated, it is necessary to push the percussion device with sufficient force towards the material. This, in turn, brings about a problem that the extra force must be taken into account both in the supporting structures of the percussion device and elsewhere, as a result of which the size and mass of the apparatus as well as the manufacturing costs will increase. Inertia resulting from the mass of the percussion piston restricts the frequency of the reciprocating motion of the percussion piston, and thus, the impact frequency, which, instead, should be considerably raised from the present level in order to achieve a more efficient result. The result of the current solutions is considerable deterioration of operating efficiency, however, and therefore it is not possible in practice.

BRIEF DESCRIPTION OF THE INVENTION

It is an object of the present invention to provide a percussion device, advantageously for a rock drilling machine or the like, in which adverse effects of percussion-induced dynamic forces are lower than in the known solutions and by which it will be easier to increase the impact frequency than at present. The percussion device of the invention is characterized in that the means for providing a stress pulse include an energy storing space, which is located in the body of the percussion device and limited by the body of the percussion device and a separate transmission element located movably in the axial direction of the tool with respect to the body of the percussion device, the energy storing space being filled with elastic and reversible compressible energy storing material, means for bringing the energy storing material to stress state by increasing its pressure so that when the energy storing material is in a desired state of stress, the transmission element is in a position with respect to the body of the percussion device, from which position it can move with respect to the body of the percussion device towards the tool, and correspondingly, means for releasing the transmission element abruptly to move towards the tool, whereby the energy stored in the energy storing material is discharged as a stress pulse via the transmission element to the tool that is directly or indirectly in contact therewith.

The basic idea of the invention is that energy storable in an elastic and reversible, compressible material, which is compressed and whose compressibility is relatively low, such as fluid, rubber, elastomer, etc, is used for providing an impact. The energy is transferred to the tool by releasing the compressed material abruptly from the stress state, whereby the material tends to restore its rest volume and by means of the stored stress energy it delivers an impact, i.e. a stress pulse, to the tool.

The invention has an advantage that the impulse-like impact motion provided in this manner does not require a reciprocating percussion piston, and therefore large masses are not moved to and fro in the striking direction, and the dynamic forces remain low as compared with the dynamic forces of heavy reciprocating percussion pistons in the known solutions. Further, the present structure enables a raised impact frequency without considerable deterioration of operating efficiency.

BRIEF DESCRIPTION OF THE DRAWINGS

In the following the invention will be described in greater detail in connection with the attached drawings, wherein.

DETAILED DESCRIPTION OF THE INVENTION

Figure 1:
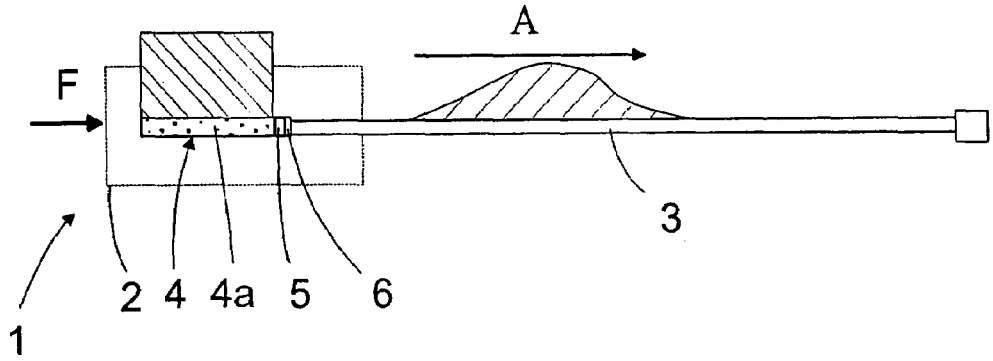
FIG. 1 shows schematically an operating principle of a percussion device according to the invention.

FIG. 1 shows schematically an operating principle of a percussion device according to the invention. In the figure, a broken line indicates a percussion device 1 and its body 2, at one end of which there is mounted a tool 3 that is movable in its longitudinal direction with respect to the percussion device 1. Inside the body 2 there is an energy storing space 4, which is filled with elastic and reversible, compressible energy storing material 4*a*. The energy storing space 4 is partly limited by a transmission element 5 between the energy storing material 4*a* and the tool 3, which element can move in the axial direction of the tool 3 with respect to the body 2. Fluid, which constitutes by way of example the energy storing material 4*a*, is compressed with such a force that its volume, i.e. in this case its axial length in the direction of the tool 3, changes as compared with the length at rest. Correspondingly, the fluid pressure changes, i.e. rises, in proportion to the compression. Naturally, to generate stress in the energy storing material requires energy that is made to affect the energy storing material 4*a* in various ways hydraulically, for instance, of which there are practical examples in FIGS. 2 and 3.

As the energy storing material is stressed, for instance compressed as in the figure, the percussion device 1 is pushed forwards such that the end of the tool 3 is firmly pressed against the transmission element 5 either directly or through a separate transmission piece, such as a shank adapter or the like. By releasing abruptly the stress state of the material a stress wave is produced, which propagates in the direction of arrow A, in a drill rod or another tool and which delivers an impact on reaching the front end of the tool in the material to be treated, in the same way as in the known percussion devices.

The length and the intensity of the propagating stress wave, are in proportion to the volume and stress state of the energy storing material as well as to the physical characteristics of the tool and the energy storing material.

Figure 2:
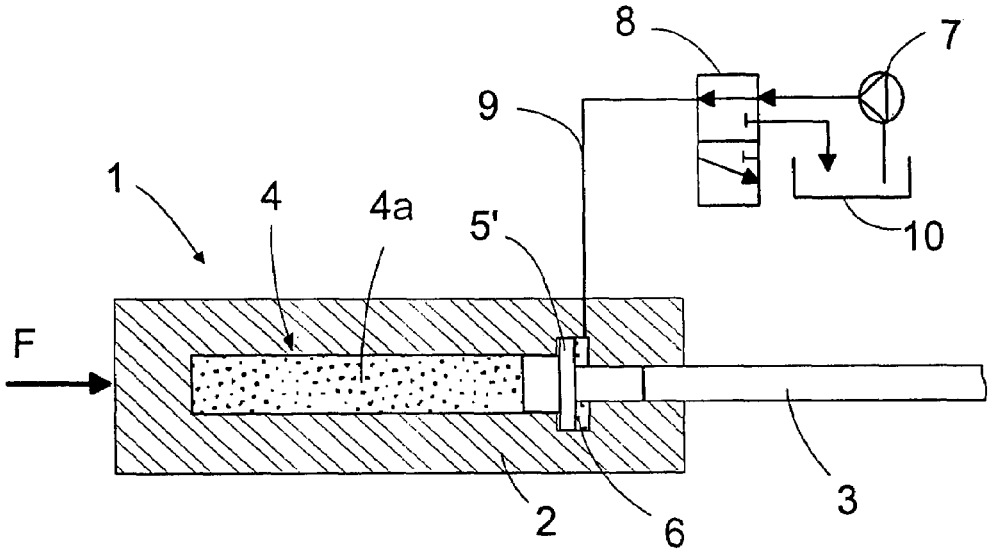
FIG. 2 shows schematically an embodiment of the percussion device according to the invention.

FIG. 2 shows schematically an embodiment of a percussion device according to the invention. In this embodiment a transmission piston serves as a transmission element 5 between the energy storing material 4*a* and the tool 3. Between the transmission piston 5' and the body 2 there is a separate working cylinder 6, into which pressure medium can be fed so as to generate stress. The pressure fluid is fed from a pressure fluid pump 7 via a channel 9 to the working cylinder 6 controlled by a valve 8 for generating stress. Thus, the pressure of the pressure fluid pushes the transmission piston 5' to the left as indicated in FIG. 2, whereby the fluid constituting the energy storing material 4*a* is compressed in the axial direction of the tool 3 and its pressure rises. As the prestress has reached a desired level, the position of the valve 8 is changed such that the pressure fluid can be discharged from the working cylinder 6 to a pressure fluid container 10 and the fluid pressure in the compressed energy storing material 4*a* tends to transfer the transmission piston towards to the tool 3. Because the percussion device 1 is pushed in the manner known per se by a feeding force F towards the tool 3, and the tool 3 is pushed through the energy storing material via the transmission piston towards material to be broken, not shown, a stress pulse is generated in the tool 3 and this stress pulse propagates through the tool 3 to the material to be broken and makes the material break. In the embodiment of FIG. 2, the surface of the transmission piston 5' facing the working cylinder 6 has a larger cross-section than the surface facing the energy storing material 4*a*. However, this is in no way restrictive in this embodiment, but the surfaces may be equal in size, have the same proportions as in FIG. 2 or vice versa. Further, FIG. 2 does not propose any particular seals known per se in relation to the transmission piston and the working cylinder or the walls of the energy storing space 4 containing the energy storing material 4*a*, because the seals are generally known per se and apparent to a person skilled in the art, and they are not relevant to the actual invention. Any suitable structure known per se can be applied to the sealing solutions.

Figure 3:
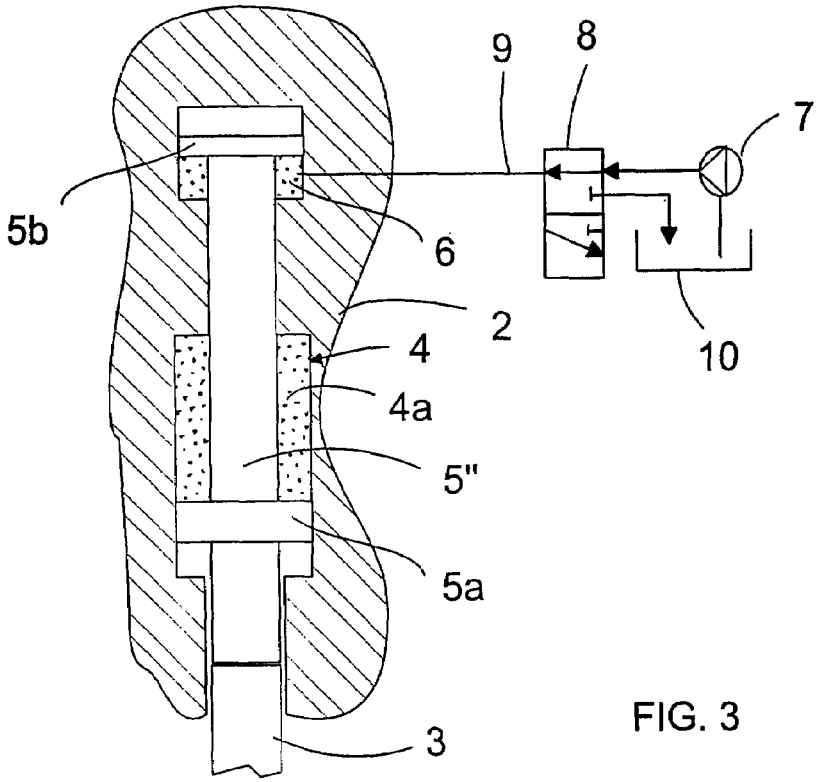
FIG. 3 shows schematically a second embodiment of the percussion device according to the invention.

FIG. 3 shows a second embodiment of the percussion device according to the invention. In this embodiment the stressing of the energy storing material is implemented with a two-part transmission piston. In this embodiment the transmission piston 5" comprises a separate working flange 5*a*, which closes at one end the energy storing space 4 containing the fluid that serves as the energy storing material 4*a*. Correspondingly, the transmission piston 5" extends outside the energy storing space 4, at the end opposite to the tool 3, into a separate working cylinder space 6, where there is a separate auxiliary piston 5*b* associated with the transmission piston 5". In this embodiment the transmission piston is pulled by feeding pressure fluid in the working cylinder 6 by means of the auxiliary piston 5*b*, whereby the fluid acting as the energy storing material 4*a* is compressed. At the same time, part of the energy is also stored in the transmission piston 5" as tensile stress. Otherwise the operation of this solution corresponds to that of FIG. 2.

Figure 4:
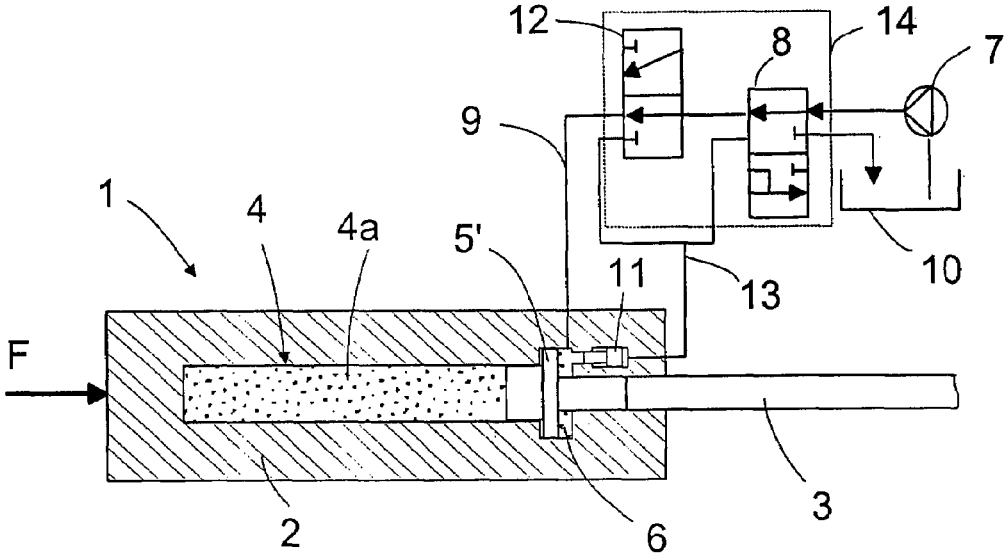
FIG. 4 shows schematically a third embodiment of the percussion device according to the invention.

FIG. 4 shows schematically a third embodiment according to the invention. It proposes a structure by which the magnitude of a stress pulse can be raised without the pressure fluid pump 7 having to provide particularly high pressure of the pressure fluid. This embodiment comprises one or more separate pressure intensifier pistons 11 communicating with the working cylinder 6. In the case shown in FIG. 4, the intensifier piston is in its rest position. Pressurized fluid can then be fed into the working cylinder 6 in the previously described manner. When the pressure of the pressure fluid is sufficient in the working cylinder 6, the pressure fluid feed is stopped with a valve 12, and at the same time the pressure fluid feed is conducted via a channel 13 to the pressure intensifier piston 11. By feeding the pressure fluid the pressure intensifier piston 11 is pushed towards the cylinder space of the working cylinder 6, whereby the pressure in the working cylinder 6 further increases and consequently the volume of the fluid acting as the energy storing material 4*a* further reduces and the pressure correspondingly rises. After pushing the pressure intensifier piston 11 to a desired point, the pressure fluid flow is released abruptly from the working cylinder 6 and from behind the pressure intensifier piston 11, whereby a stress pulse is generated in the tool in the previously described manner.

As shown in FIG. 4, it is possible to push the pressure intensifier piston by means of a separate control valve 12 utilizing the pressure of the pressure fluid pump 7. In that case when the valve 12 is switched downwards from the position shown in FIG. 4 the pressure fluid channel 9 leading to the working cylinder 6 is closed and the pressure fluid flows to the pressure intensifier piston 11. Correspondingly, when the valve 8 is switched upwards from the position shown in FIG. 4 and the valve 12 is restored to the position of the figure, the pressure fluid can be discharged both from the working cylinder 6 and from behind the pressure intensifier piston 12, whereby a stress pulse is generated.

Figure 5:
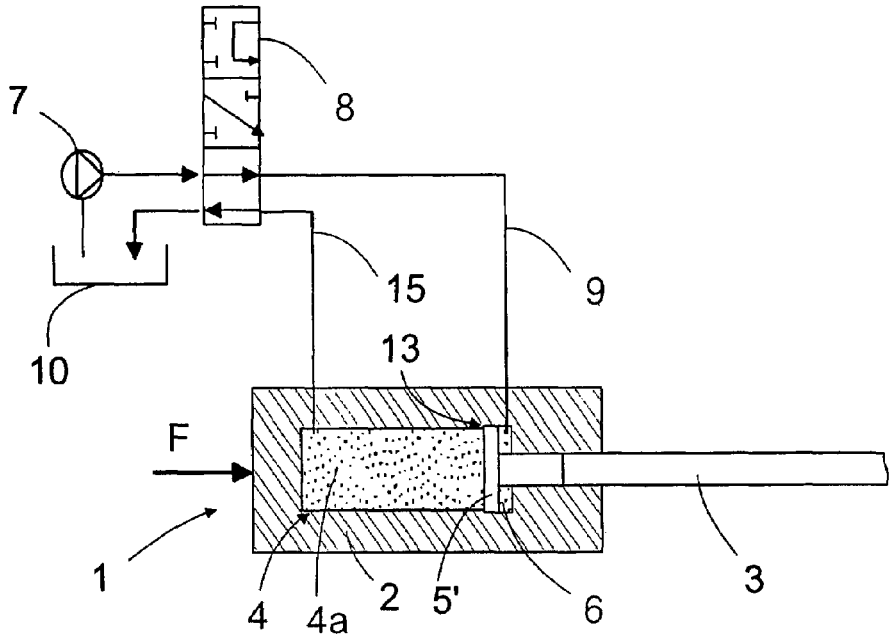
FIG. 5 shows schematically a fourth embodiment of the percussion device according to the invention.

FIG. 5 shows schematically a fourth embodiment of the invention. In this embodiment, the pressure of the pressure fluid in the working cylinder is used for enhancing the stress pulse to be provided in the tool. In this embodiment, at the beginning of a working phase the transmission piston 5' moves against shoulders 13 on the left in the figure, and the pressure fluid from the pump 7 is fed into the working cylinder 6 and pressure fluid will be discharged from the energy storing space 4 into the pressure fluid container 10. Thereafter the valve 8 is switched downwards in the figure to its midmost position, whereby the channel 9 leading to the working cylinder 6 is closed and a closed pressure fluid space is formed. At the same time, pressure fluid is fed from the pump 7 into the energy storing space 4, and the pressure fluid therein is compressed to have a smaller volume than originally by the effect of the intruding pressure fluid, and the pressure in the space 4 rises. Because the pressure surface of the transmission piston 5 is larger on the side of the energy storing space 4 than on the side of the working cylinder 6, the pressure in the working cylinder rises higher than the pressure from the pump 7 in the inverse proportion to the pressure surfaces. After feeding a sufficient amount of pressurized fluid acting as the energy storing material 4*a* from the pump 7 into the energy storing space 4, the valve is switched further downwards to its third position, in which the pressure fluid supply from the pump 7 is blocked and the highly pressurized pressure fluid can flow from the working cylinder 6 into the energy storing space 4 until the pressures are equal. As this is done abruptly, the transmission piston 5' tends to move in the direction of the tool 3 generating thus a stress pulse in the tool 3 in the previously described manner.

Figure 6:
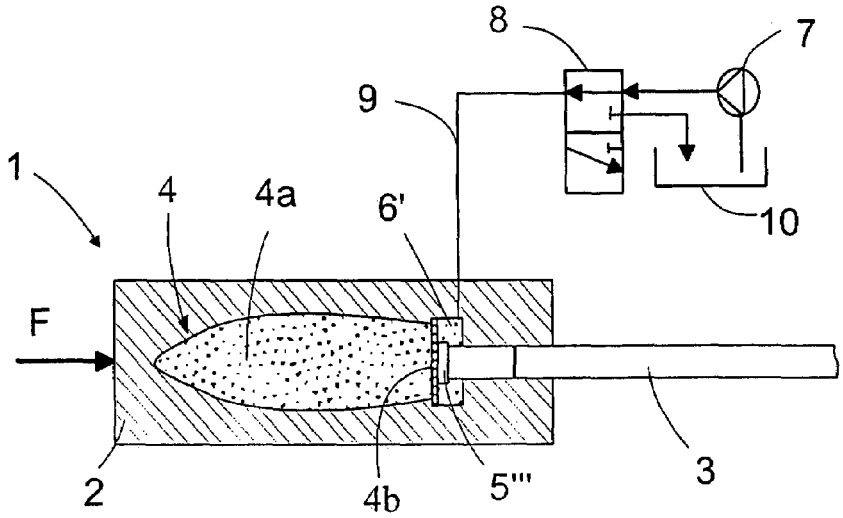
FIG. 6 shows schematically a fifth embodiment of the percussion device according to the invention.

FIG. 6 shows a fifth embodiment of the percussion device according to the invention. In this embodiment the energy storing space differs in shape from the previous embodiments. The energy storing space 4 is limited by a separate membrane 4*b*, which results in a closed energy storing space 4. On the other side of the membrane 4*b* there is a separate transmission piece 5''' that acts as the transmission element and is in direct or indirect contact with the tool 3. Further, there is a pressure fluid space 6' on the side of the membrane 4*b* facing the tool 3. When pressure fluid is fed into the pressure fluid space 6', and correspondingly, when pressure is released from the pressure fluid space, a stress pulse is generated in the tool in the previously described manner.

Figure 7:
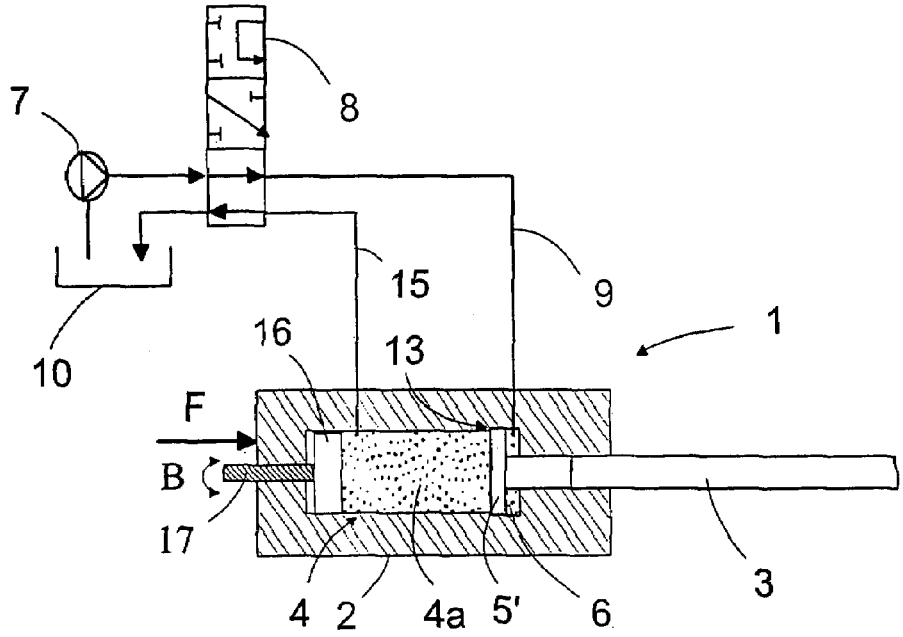
FIG. 7 shows schematically a sixth embodiment of the percussion device according to the invention.

FIG. 7 shows schematically a sixth embodiment of the percussion device according to the invention. This embodiment corresponds to the solution of FIG. 5 in all other respects but the energy storing space is provided with a separate volume adjustment piston 16, which in this case, by way of example, adjusts the length of the energy storing space having a constant cross-section. The piston position can be changed by adjustment means, such as a mechanical screw, which is schematically illustrated by a screw 17. When the screw is turned in either direction as indicated by arrow B, the adjustment piston 16 moves in the energy storing space 4 such that the volume of the space 4 reduces or increases depending on the turning direction of the screw 17. Instead of the screw 17 it is possible to use any other solution known per se for shifting the adjustment piston 16 and thus for adjusting the volume of the energy storing space 4. The change in the volume can be used for controlling the properties, such as amplitude and length, of the stress pulse.

Figure 8:
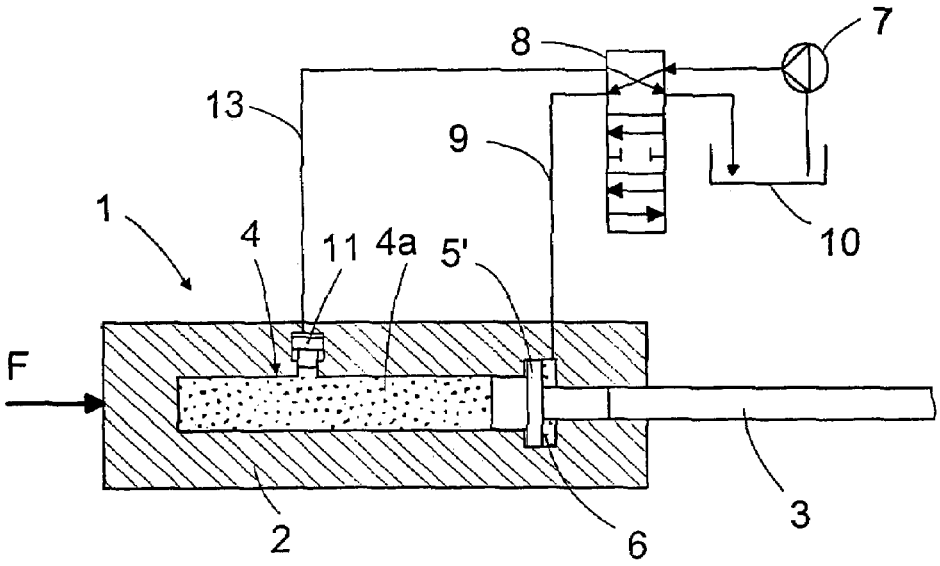
FIG. 8 shows a seventh embodiment of the percussion device according to the invention.

FIG. 8 shows a seventh embodiment of the percussion device according to the invention. This embodiment corresponds in part to that shown in FIG. 4. However, in this embodiment the pressure intensifier piston 11 is located on the side of the energy storing space 4. The operation takes place such that when the valve 8 is in the position shown in FIG. 8, pressure fluid flows from the pressure fluid pump 7 into the working cylinder 6 pushing the transmission piston 5' towards the energy storing space 4*a*. At the same time, the pressure fluid is able to flow from behind the pressure intensifier piston 11 into the pressure fluid container 10 in the manner which enables the transmission piston 5' to push its flange against the shoulders. Thereafter the valve 8 is switched from the position shown in FIG. 8 to the midmost position, i.e. upwards in the figure, whereby the working cylinder 6 will become a closed space and pressure fluid flows from the pump 7 via the channel 13 behind the pressure intensifier piston 11 pushing it towards the energy storing space 4*a*, and consequently the pressure in the energy storing space rises as the volume reduces. At the same time the pressure in the working cylinder also rises, because the pressure liquid cannot be discharged therefrom. After the pressure in the energy storing space 4 has reached a sufficiently high level, the valve 8 is switched to its third position, which allows the pressure fluid in the working cylinder 6 to be discharged into the pressure fluid container and a stress pulse is generated in the tool in the previously described manner. In the situation shown in FIG. 8 the pressure fluid continues to be fed behind the pressure intensifier piston 11 in the third position of the valve 8, but if desired, it is possible to discontinue the feed of the pressure fluid in said situation. However, in this embodiment the pressure fluid feed behind the pressure intensifier piston 11 enhances the power of the stress pulse slightly.

In the above embodiments the invention is described only schematically and also the valves and the couplings associated with the pressure fluid feed are described only schematically. To implement the invention, it is possible to use any suitable valve solutions known per se, and for instance the valves 8 and 12 can constitute one single control valve as schematically indicated by a broken line 14. The valves 8 and 12 can also be independent, separately controlled valves having one or more channels for feeding the pressure fluid into the working cylinder 6 and discharging it therefrom, respectively. Instead of the hydraulic pressure intensifier apparatus it is possible to use any mechanical or mechanical hydraulic apparatus for pushing the pressure intensifier piston 11. Correspondingly, the pressure intensifier solution can also be applied to the embodiment of FIG. 3 and other embodiments of the invention defined in the claims.

In the above description and the drawings the invention is only presented by way of example and it is not restricted thereto in any way. It is essential, for providing a stress pulse in a tool, to use elastic and reversible, compressible material, whose compressibility is relatively low, which is stored in a separate energy storing space, and which is compressed by a desired force to create a desired stress state, i.e pressure, whereafter the energy storing material is abruptly released so that the pressure therein is discharged directly or indirectly to a tool end and further through the tool to the material to be broken. Instead of a liquid, the elastic and reversible, compressible material can be a substantially solid or porous material, such as rubber, polyurethane, elastomer or a similar elastic material, whose compression index is substantially lower than that of gases. The transmission piston can be separate from the tool, but in some cases it can also be an integral part of the tool. The transmission element, such as transmission piston, is pushed towards the energy storing material as described e.g. in connection with FIG. 2 until the desired level of press in the material and thus the desired state of stress has been reached, whereby the transmission element is in a position corresponding to the desired state of stress. Also, the transmission element, or transmission piston, can be pushed, as described for instance in connection with FIG. 8, to a predetermined position, which is defined by shoulders or corresponding mechanical means, which stop the transmission element to a predetermined place with respect to the body of the percussion device irrespective of what is the state of energy stored in the energy storing material.

The invention claimed is:

1. A percussion device having means for providing a stress pulse in a tool connected to the percussion device, wherein the means for providing a stress pulse include:

an energy storing space, which is located in the body of the percussion device and limited by the body of the percussion device and a separate transmission element located movably in the axial direction of the tool with respect to the body of the percussion device, the energy storing space being filled with elastic and reversible, compressible energy storing material, the energy storing material being liquid, means for bringing the energy storing material to stress state by increasing its pressure so that when the energy storing material is in a desired state of stress, the transmission element is in a position with respect to the body of the percussion device, from which position the transmission element can move with respect to the body of the percussion device towards the tool, and means for releasing the transmission element abruptly to move towards the tool, whereby the energy stored in the energy storing material is discharged as a stress pulse via the transmission element to the tool that is directly or indirectly in contact therewith, and wherein the transmission element is a membrane that limits the energy storing space.

2. A percussion device as claimed in claim 1, wherein between the membrane and the tool there is a separate transmission piece in direct or indirect contact with the tool, wherein the transmission piece comprises a pressure fluid space on the side of the membrane facing the tool and means for feeding the pressure fluid into the pressure fluid space and releasing the pressure from the pressure fluid space, respectively.

3. A percussion device as claimed in claim 2, wherein the transmission piece is secured to the membrane.

4. A percussion device as claimed in claim 2, further comprising a pressure intensifier piston communicating with the pressure fluid space and means for moving the pressure intensifier piston towards the pressure fluid space so that the volume of the pressure fluid space reduces and the pressure in the pressure fluid space rises and means for releasing the pressure intensifier piston to move away from the pressure fluid space so that the volume of the pressure fluid space increases and the pressure in the pressure fluid space decreases respectively.

5. A percussion device as claimed in claim 4, wherein the pressure intensifier piston is pushed towards the working cylinder or the pressure fluid space hydraulically.

6. A percussion device as claimed in claim 2, and further comprising a pressure intensifier piston communicating with the energy storing space and means for transferring the pressure intensifier piston towards the energy storing space such that the volume of the energy storing space reduces and the pressure in the energy storing space and correspondingly in the pressure fluid space rises, and means for releasing the pressure intensifier piston to move away from the energy storing space, after the discharge of the stored energy as a stress wave to the tool, such that the volume of the energy storing space increases and the pressure in the energy storing space decreases respectively.

7. A percussion device as claimed in claim 1, wherein the energy storing space comprises an adjustment piston and adjustment means for moving the adjustment piston into the energy storing space and correspondingly away therefrom so as to alter the volume of the energy storing space.

8. A percussion device as claimed in claim 7 wherein the energy storing space has a constant cross-section and that the length of the energy storing space is adjusted by moving the adjustment piston.

9. A percussion device as claimed in claim 1, wherein the percussion device is adapted for use with a rock drilling machine.

* * * * *